US006532689B1

(12) United States Patent
Jones, Jr.

(10) Patent No.: US 6,532,689 B1
(45) Date of Patent: Mar. 18, 2003

(54) SLIPPER

(76) Inventor: Leslie O. Jones, Jr., P.O. Box 340681, Columbus, OH (US) 43234-0681

( * ) Notice: Subject to any disclaimer, the term of this patent is extended or adjusted under 35 U.S.C. 154(b) by 0 days.

(21) Appl. No.: 09/358,532

(22) Filed: Jul. 22, 1999

(51) Int. Cl.[7] ..... A43B 7/14

(52) U.S. Cl. ..... 36/88; 36/9 R; 36/141; 36/15; 36/100

(58) Field of Search ..... 36/9 R, 10, 15, 36/141, 153, 100, 136, 11.5

(56) References Cited

U.S. PATENT DOCUMENTS

| | | | | | |
|---|---|---|---|---|---|
| 1,030,085 | A | * | 6/1912 | Hale | 36/11.5 |
| 1,286,446 | A | * | 12/1918 | Thoma, Jr. | 36/11.5 |
| 1,735,434 | A | * | 11/1929 | Hohenstein | 36/11.5 |
| 2,205,091 | A | * | 6/1940 | Geffner | 36/11.5 |
| 2,400,023 | A | * | 5/1946 | Potter | 36/141 |
| 2,762,134 | A | * | 9/1956 | Town | 36/153 |
| 4,276,671 | A | | 7/1981 | Meelton | |
| 4,317,292 | A | | 3/1982 | Melton | |
| 4,372,057 | A | | 2/1983 | Nielsen | |
| D275,715 | S | | 10/1984 | Boone | |
| 4,813,162 | A | * | 3/1989 | Harris | 36/88 |
| 5,220,735 | A | * | 6/1993 | Raoul-Duval | 36/8.3 |
| D346,062 | S | | 4/1994 | Owens | |
| 5,526,584 | A | | 6/1996 | Bleimhofer et al. | |
| 5,617,585 | A | | 4/1997 | Fons et al. | |
| 5,746,013 | A | | 5/1998 | Fay, Sr. | |
| 5,878,510 | A | * | 3/1999 | Schoesler | 36/153 |

FOREIGN PATENT DOCUMENTS

| | | | | |
|---|---|---|---|---|
| EP | 383685 | * | 8/1990 | 36/141 |

* cited by examiner

*Primary Examiner*—Mickey Yu
*Assistant Examiner*—Jila M. Mohandesi
(74) *Attorney, Agent, or Firm*—Patent & Trademark Services; Joseph H. McGlynn

(57) ABSTRACT

A slipper which has an aperture in the bottom and three different types of inserts which can be inserted into the aperture. The first insert will be filled with a material that conforms to the wearer's foot, while the second insert will be filled with a mixture of sand and marbles. The third insert will be filled with neoprene balls.

7 Claims, 1 Drawing Sheet

SLIPPER

BACKGROUND OF THE INVENTION

This invention relates, in general, to slippers, and, in particular, to slippers with interchangeable inserts.

DESCRIPTION OF THE PRIOR ART

In the prior art various types of slippers have been proposed. For example, U.S. Pat. No. Des. 346,062 to Owens discloses a slipper with a therapeutic pad in the heel.

U.S. Pat. No. Des. 275,715 to Boone discloses slippers with a tread design on the bottom.

U.S. Pat. No. 4,372,057 to Nielsen discloses a slipper with a moisture absorbent insole.

U.S. Pat. No. 5,526,584 to Bleimhofer et al discloses a slipper with a water proof layer.

U.S. Pat. No. 5,617,585 to Fons et al discloses a slipper with a rubber liner.

U.S. Pat. No. 5,746,013 to Fay discloses a shoe with an air-cooled, breathable liner.

U.S. Pat. No. 4,317,292 to Melton discloses a slipper sock with a sole attached thereto.

U.S. Pat. No. 4,276,671 to Melton discloses a method of making a slipper sock.

SUMMARY OF THE INVENTION

The present invention is directed to a slipper which has an aperture in the bottom and three different types of inserts which can be inserted into the aperture. The first insert will be filled with a material that conforms to the wearer's foot, while the second insert will be filled with a mixture of sand and marbles. The third insert will be filled with neoprene balls.

It is an object of the present invention to provide a new and improved slipper which has a plurality of inserts which can be inserted into the slipper.

It is an object of the present invention to provide new and improved slipper which will have a therapeutic affect on the wearer.

It is an object of the present invention to provide new and improved slipper which will have a plurality of inserts which can be easily changed by the wearer.

These and other objects and advantages of the present invention will be fully apparent from the following description, when taken in connection with the annexed drawings.

DESCRIPTION OF THE PREFERRED EMBODIMENT

Figure 1:
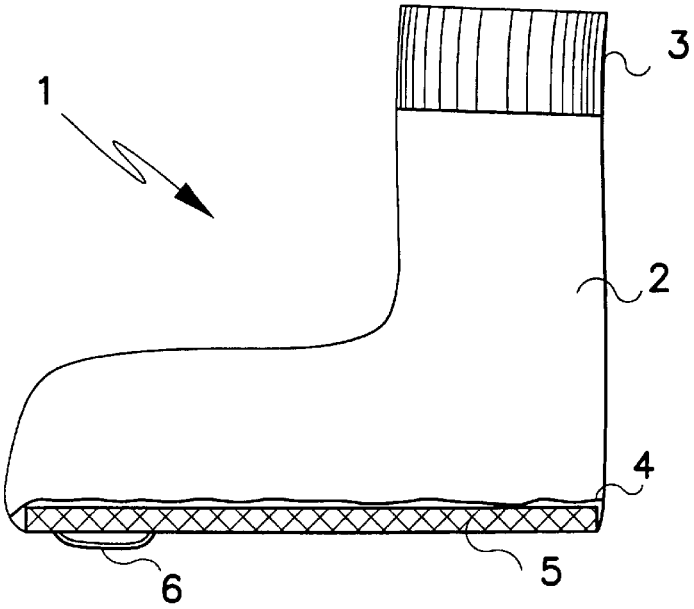
FIG. 1 is a side view of the present invention.

Referring now to the drawings in greater detail, FIG. 1 shows a side view of the slipper 1 of the present invention.

The body 2 of the slipper 1 is preferably made from a durable material such as, but not limited to, Nylon, however, any durable material can be used without departing from the scope of the invention.

The top of the slipper has stretchable ribbing 3 secured thereto in any conventional manner to provide a tight fit around the user's ankle or leg to help prevent the slipper 1 from slipping off the user's foot. The bottom of the slipper 1 has a safety tread 6 secured thereto in any conventional manner.

Figure 2:
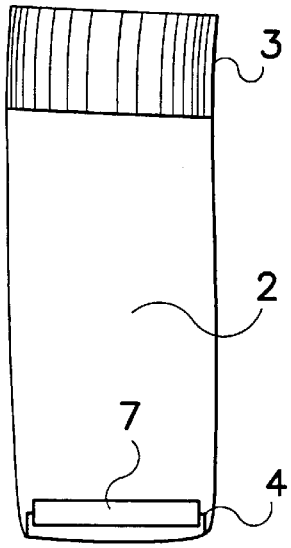
FIG. 2 is a back view of the present invention.

As shown in FIG. 2, the back of the slipper 1 has an aperture 4 near the lower portion of the slipper. As shown in FIG. 1, this aperture extends from the back to the front of the slipper. Also, as shown in FIG. 2, the back of the slipper has a fastener 7 secured thereto above the aperture 4. The fastener 7 covers at least part of the aperture and will, when it covers at least part of the aperture 4, prevent the inserts 5, 5', 5", shown in FIGS. 3–4 from slipping out of the aperture 4. The preferred type of fastener 7 is a hook and loop fastener which will adhere to both the back of the slipper and to the rear of the inserts, however other types of fasteners can be used without departing from the scope of the invention.

Figure 3:
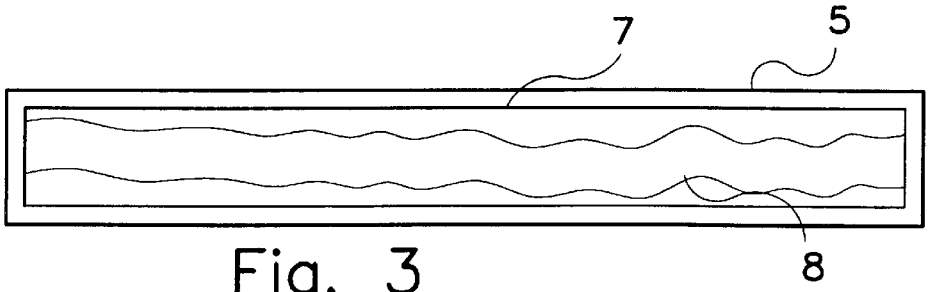
FIG. 3 is a cross-sectional view of one of the inserts used with the present invention.
Figure 4:
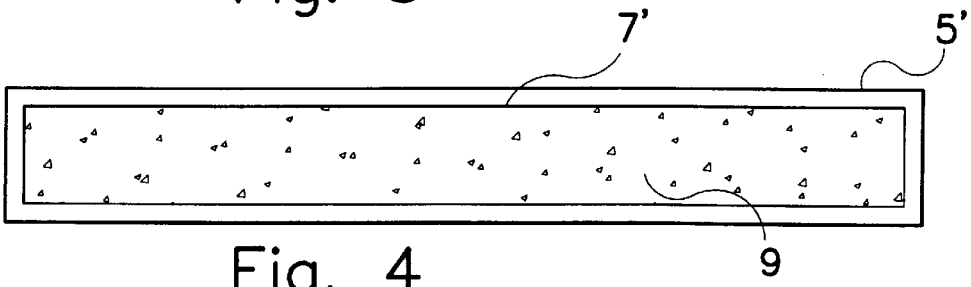
FIG. 4 is a cross-sectional view of another of the inserts used with the present invention.
Figure 5:
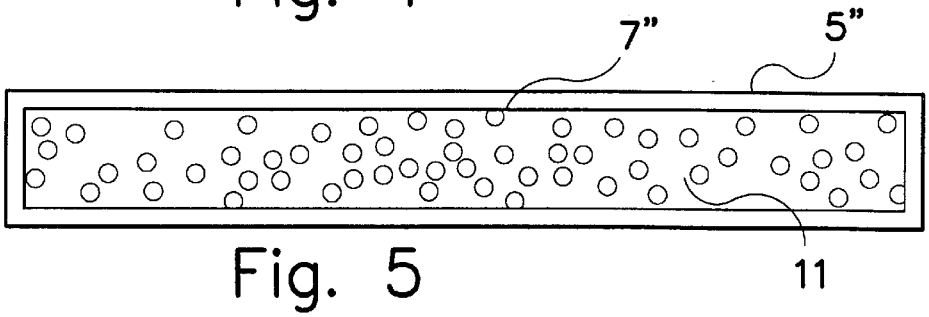
FIG. 5 is a cross-sectional view of another of the inserts used with the present invention.

As shown in FIGS. 3–5, the slipper of the present invention comes with three different types of inserts 5, 5', 5". Each of the inserts can be inserted into the aperture 4 in the slipper and secured therein with the fastener 7. Each of the inserts 5, 5', 5" has a hollow portion 7 which will be filled with different types of materials. The inserts 5, 5', 5" will be made from a flexible material so the inserts can be passed into the aperture 4 with little effort and secured therein.

The insert 5 will have a liquid such as water or a gel 8 sealed within the hollow 7 in the insert 5 by any conventional method. The water or gel 8 will provide the wearer with a soft, comforting surface to walk on while wearing the slipper.

The insert 5', shown in FIG. 4, will have a combination of sand 9 and marbles 10 sealed within the hollow 7'. The sand 9 will prevent the marbles 10 from bunching and collecting in one area of the insert. The combination of the sand 9 and the marbles 10 will provide a moderate amount of stimulation to the bottom of the wearer's feet, and will, therefore, provide a moderate massage to the wearer's feet as they walk in the slippers.

The insert 5", shown in FIG. 5, will have a plurality of ¾ inch neoprene balls 11 sealed within the hollow 7" of the insert 5". Neoprene is the selected material for the balls 11 since it is a firm material but also has a bit of "give" to provide some cushioning and a significant amount of pressure when a wearer steps on the insert. Due to the size of the balls 11 and the dimensions of the hollow 7", the balls will not bunch up and congregate in one area of the insert 5". The balls 11 due to their size, and density of the material they are made from, will provide an intense stimulation to the bottom of the wearer's feet.

In all of the inserts 5, 5', 5", the thickness of the material that the inserts are made from should be sufficient to provide strength for the insert so it will not rupture, yet the inserts will be thin enough so the level of stimulation is not significantly altered. Each insert will have heat sealed edges so as to contain the filler without sewn seams, to thereby provide a comfortable feel for the wearer.

Through the use of the inserts, the user can decide what amount of comfort or "massage effect" is desired, and then can select the proper insert and merely slide the insert into the bottom of the slipper and secure it with the fastener 7.

Since the inserts are easy to insert into the slipper, a user can easily change from one insert to another depending on the user's desire.

Although the Slipper and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A slipper comprising:

a body portion adapted to be worn on the feet of a user, said body portion having a top and a bottom, aperture means for receiving a selected insert adjacent said bottom, said aperture means extending along substantially the entire bottom of said body portion and communicating with an outside surface of said body portion, a plurality of inserts adapted to be positioned within said aperture means, fastener means for securing said insert within said aperture means, and wherein said plurality of inserts each have a hollow portion formed therein, and wherein each hollow portion of said plurality of inserts have a different type of filling within said hollow portion.

2. The slipper as claimed in claim 1, wherein one of said plurality of inserts is filled with water.

3. The slipper as claimed in claim 1, wherein one of said plurality of inserts is filled with a gel.

4. The slipper as claimed in claim 1, wherein one of said plurality of inserts is filled with a combination of sand and spherical objects.

5. The slipper as claimed in claim 4, wherein said spherical objects are marbles.

6. The slipper as claimed in claim 1, wherein one of said plurality of inserts is filled with a plurality of balls.

7. The slipper as claimed in claim 6, wherein said balls are made from noeprene.

* * * * *